United States Patent [19]

Anderson

[11] Patent Number: 4,463,828

[45] Date of Patent: Aug. 7, 1984

[54] PUMP JACK

[76] Inventor: Carl Anderson, 12 St. Stephens Pl., Staten Island, N.Y. 10306

[21] Appl. No.: 332,015

[22] Filed: Dec. 18, 1981

[51] Int. Cl.[3] ..... A63B 27/00

[52] U.S. Cl. ..... 182/136; 248/243; 254/106

[58] Field of Search ..... 248/243, 244, 245; 182/133, 136, 141, 135; 254/106

[56] References Cited

U.S. PATENT DOCUMENTS

| | | | |
|---|---|---|---|
| 361,944 | 4/1887 | Hawkins | 254/106 |
| 2,849,211 | 8/1958 | Shoesmith | 254/106 |
| 2,854,293 | 9/1958 | Riblet | 248/245 |
| 3,778,013 | 12/1973 | Selenke | 248/243 |
| 4,008,785 | 2/1977 | Mugnaini | 182/133 |
| 4,382,488 | 5/1983 | Anderson | 182/136 |

*Primary Examiner*—William H. Schultz
*Assistant Examiner*—Ramon O. Ramirez

[57] ABSTRACT

A pump jack for traveling up and down a pole. The pump jack includes a frame member supporting a lower shackle member which includes front and rear clamping bars which can apply a coupling force for gripping the pole. A pump arm is pivotally coupled to the frame member and further pivotally supports an upper shackle member having a front helical rod and a rear clamping bar for also applying a clamping force for gripping the pole. The two shackle members are suitably biased to alternately position one of the shackle members in gripping relationship with the pole. The pump arm is used to step upwardly the pump jack along the pole. A release mechanism is coupled to the lower shackle for disengaging it from the pole. An over the center spring loaded handle coupled to the helical rod is used to roll the pump jack down the pole. The handle prevents accidental downward rolling during the upward stepping of the pump jack along the pole.

13 Claims, 8 Drawing Figures

PUMP JACK

BACKGROUND OF THE INVENTION

This invention relates to scaffold equipment and more particularly to a pump jack arranged for traveling up and down a pole.

When placing siding on a building or carrying out other types of construction, scaffolding equipment is required. Instead of erecting complex scaffolding apparatus, there has been developed the use of pump jack poles which are braced to a vertical surface and pump jacks are placed on the poles for riding up and down the poles. The pump jacks support a platform on which the workers stand. By means of a pump arm, which is typically manipulated by the foot, the worker can bring the platform up the pole.

Typically, at least two poles are spanned from each other and braced to the vertical side wall of the building. A pump jack is placed on each pole. The pump jack includes a platform support and planks or other types of platform are spanned across the platform supports of the respective pump jacks. The worker stands on the platform and manipulates the jack by means of his foot which is used to pump the jack and thereby raise it stepwise manner up the pole. Various mechanisms are utilized for lowering the pump jack down the pole. For example, a crank can be provided connected to a spiral which is used to wind down the pump jack.

One early form of pump jack is described in U.S. Pat. No. 2,240,682 which described a number of gripers which alternately grip and release the pole. Numerous levers cooperate with the grippers. One of the levers serves as a pump arm and by oscillating the arm, the jack is raised step by step along the pole.

An improved version of the pump jack is shown in FIG. 1 and includes upper and lower shackles which are alternately caused to grip the pole by means of the pumping action of the foot pedal. When the lower shackle grips the pole, the foot pedal steps up the upper shackle. With the upper shackle gripping, the action of the foot pedal steps up the frame with respect to the pole. The pump jack is lowered by releasing the lower shackle and cranking down the helical rod connected to the upper shackle. This prior art device will be explained more fully hereinafter.

One of the most critical aspects of using a pump jack is its amount of safety. Since the worker is held at very high levels by means of the pump jack, it is of extreme importance that the pump jack is operating in a safe as possible way. However, the specific construction of prior art pump jacks have raised concern about their safety and have brought about a need for redesigning aspects of the pump jack.

Additionally, the specific construction of the prior art pump jack has lead to potential damage to the pole as the pump jack rides up and down and continuously grips the pole. The pump jack itself has caused eating away and cutting into the pole which has also raised a need for redesigning of the pump jack.

Most of the prior art poles heretofore utilized have been wood and typically formed of two 2 by 4s which are fastened together by nails to form a single upright pole. More recently, there has become available a pump jack pole formed of an elongated metal pole having a rubberized surface formed on at least one side of the metal pole. Such metal pump jack pole is described in my U.S. Pat. No. 4,382,488. When utilizing the metal pole described, many concepts previously held with regard to the use of pump jacks and pump jack poles have become modified. For example, it appears that the gripping force of the pump jack is essentially applied on one side with the opposing side serving only as a retaining brace. As a result, modifications of the pump jack are needed in order to further accommodate the use of such metal poles and to enhance the capabilities of the pump jack utilized in conjunction with such pump jack poles.

SUMMARY OF THE INVENTION

Accordingly, it is an object of the present invention to provide a pump jack which avoids the aforementioned problems of prior art devices.

A further object of the present invention is to provide a pump jack with improved safety.

Still a further object of the present invention is to provide a pump jack which is easier to utilize and simpler to manipulate than prior art devices.

Another object of the present invention is to provide a pump jack which can be easily stepped up a pole and easily lowered down the pole by workers standing on a platform supported by the pump jack.

A further object of the present invention is to provide a pump jack having a spring held handle for cranking down the pump jack and also providing a safety lock against accidental unwinding of a helical rod holding the pump jack on the pole.

Still another object of the present invention is to provide a pump jack pole having a foot operated pump arm with a pivotal stirrup for ease of use.

A further object of the present invention is to provide a pump jack having upper and low shackles which alternately step up a pole and with a foot operated release lever for releasing the lower shackle during rolling down of the pump jack.

Yet another object of the present invention is to provide a pump jack which includes a frame straddling a pole and which avoids cutting or scraping into the pole.

Yet another object of the present invention is to provide a pump jack having shackles with rear rollers for facilitating operation of the pump jack, especially in connection with aluminum poles.

Briefly, in accordance with the present invention, there is provided a pump jack for traveling up and down a pole. The pump jack includes a frame member which supports a lower shackle. The lower shackle includes front and rear clamping bars which apply a coupling force for gripping the pole. A pump arm is pivotally coupled to the frame member and also pivotally supports an upper shackle member. The upper shackle member includes a front helical rod and a rear clamping bar which also apply a coupling force for gripping the pole. A biasing mechanism connected to the shackles responds to the pumping action of the pump arm for alternately positioning one of the shackle members in gripping relationship with the pole. The pump arm operates in a downward pump stroke to pivotally step upward the frame member while the upper shackle member grips the pole. When the pump arm moves upwardly, it pivotally steps upward the upper shackle while the lower shackle member grips the pole and the frame is stationary. A release mechanism is connected to the lower shackle to disengage it from the pole during which time an over the center spring loaded handle which is coupled to the helical rod can be operated to roll the pump jack down the pole. The handle has a safety locking position where it is retained held in place by the pole itself and prevents accidental unwinding of the helical rod thereby avoiding slipping down of the pump jack.

In an embodiment of the invention, the release lever includes a rod having one end coupled to the lower shackle and angularly extending to the side of the frame member where again it can be operated by means of the worker's foot while the worker stands on a platform supported by the frame. In this way the operator can release the lower shackle while standing in an upright position and can operate the handle to crank down the pump jack.

In an embodiment of the invention, a stirrup is provided on the pump arm for facilitating insertion of the foot to operate the pump arm. Furthermore, rollers are utilized on the rear clamping bars of the shackles to reduce friction and facilitate climbing and descending of the pump jack along the pole. Spacers are added on the inside of the frame member to avoid scraping of the pole during operation of the pump jack.

The aforementioned objects, features, and advantages of the invention will, in part, be pointed out with particularity, and will, inpart, become obvious from the following more detailed description of the invention, taken in conjunction with the accompanying drawings which form an integral part thereof.

BRIEF DESCRIPTION OF THE DRAWINGS

In the drawings.

In the various figures of the drawing, like reference characters designate like parts.

DESCRIPTION OF THE PREFERRED EMBODIMENTS

Figure 1:
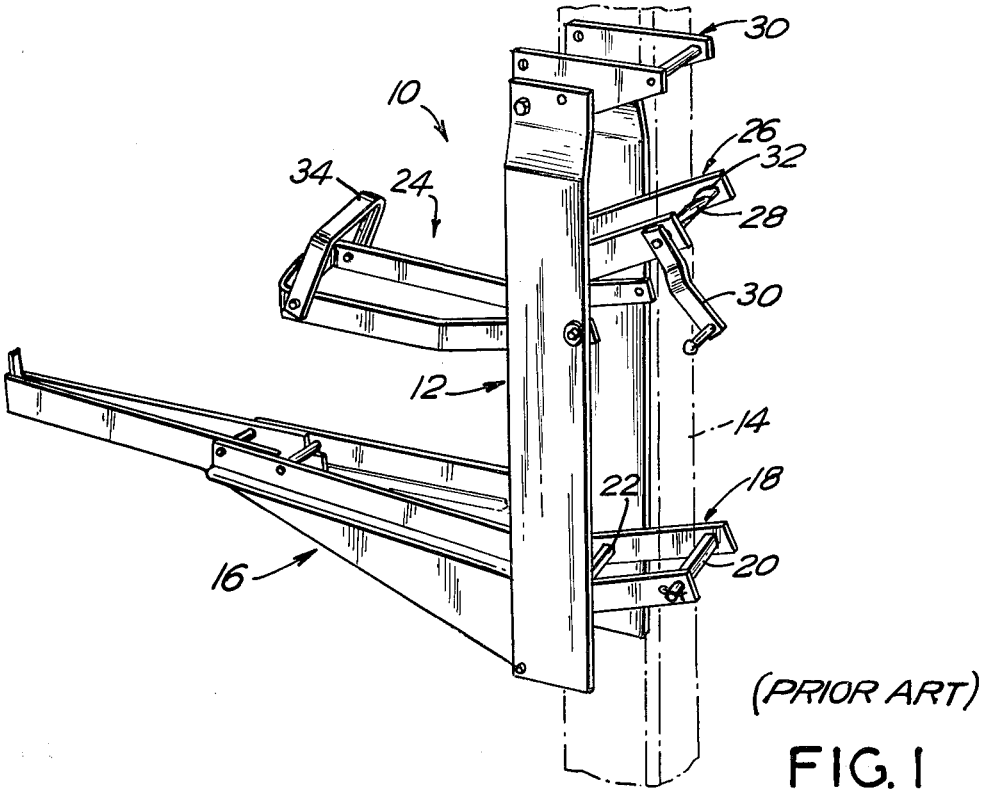
(PRIOR ART) FIG. 1
FIG. 1 is a perspective view of a prior art pump jack.

Referring now to FIG. 1, there is shown a pump jack 10 in accordance with the prior art. This pump jack will only be generally described in order to point out deficiencies present with prior art pump jacks. Details of the construction of the pump jack will be explained in connection with the improved pump jack shown in FIGS. 2–8.

A shown in FIG. 1, the pump jack includes a frame 12 which straddles a pole 14 permitting upward and downward climbing of the pump jack along the pole. A platform support 16 extends rearward of the pump jack and pivotally supports a lower shackle 18 which fits about the pole. The lower shackle is arranged with a spring bias from the lower platform as will hereinafter be explained. It is noted that the lower shackle is angularly positioned with respect to the pole so that the front bar 20 and the rear bar 22 of the lower shackle 18 can apply a coupling force to the pole and grip the opposing sides of the pole.

A pump arm 24 is pivotally coupled to the frame 12 and also pivotally supports an upper shackle 26. The upper shackle also includes a rear bar (not shown) and in place of the front bar there is provided a helical rod 28. A handle 30 is coupled to the helical rod to permit winding and unwinding of the rod. An upper clamping bracket 30 couples the upper end of the frame 12 in spaced apart relationship. The upper shackle 28 is held by means of a spring bias to the pumping arm 24.

In operation, two such pump jacks will be utilized, each positioned on its own pole and a suitable platform spanned across the platform support 16. With the pump jack mounted on a pole, the pole will pass through the upper and lower shackles 26, 18, and will also pass through the upper clamp 30. With a weight placed on the platform support, as for example a worker standing on the platform, the lower shackle will be biased so that the front and rear bars 20, 22 will bite into the front and rear of the pole and apply a coupling force to grip tightly the pole.

In order to move the pump jack upward, a foot is placed into the pump arm 24 and the pump arm is pushed downwardly. In doing so, the spring connecting the lower shackle to the platform support is slightly relaxed so that the lower shackle 18 is released from its biting into the pole and, on the other hand, by applying a force downward onto the pump arm 24, the upper shackle 26 is biased so that it will bite into the front and rear of the pole.

Continued downward movement during a pump stroke on the pump arm 24, will cause the entire frame 14 to step upward along the pole while the upper shackle 26 is gripping the pole. Upon movement upward of the pump arm 24, the lower shackle 18 again bites into the front and rear of the pole while the upper shackle 26 is released from biting into the pole. Upward movement of the pump arm 24 now steps upward the upper shackle 26 while the frame remains in position on the pole.

Accordingly, during upward climbing of the pump jack along the pole, by manipulating the pump arm 24 in an up and down manner, the pump jack will climb up the pole. The climbing occurs in stepwise fashion with initially the lower shackle clamping and gripping the pole while the upper shackle steps upward and alternately having the upper shackle grip the pole while the lower shackle and frame member steps upwardly.

In order to bring the pump jack down from the pole, the lower shackle must be completely released from gripping relationship with the pole. This is done by moving the lower shackle so that the front bar is forward of the pole. The upper shackle 26 will then be in control to grip the pole and hold the pump jack on the pole. The handle 30 can then be wound downward whereby the pump jack moves in a continuous fashion down the pole.

Although such prior art device has been widely used, there have been many problems operating such device. Some of these problems have caused safety concern while other problems have resulted in difficult operation or use. For example, during upward climbing of the pump jack along the pole, during a downward stroke of the pump arm 24, the lower shackle 18 is released and the upper shackle 26 holds onto the pole. However, it has occurred that the spiral rod 28 may unwind causing the pump jack to roll down the pole. This danger has been one of major concern since such accidental unwinding of the rod can cause the pump jack to gain momentum as it rolls down and once initial rolling starts, it is difficult to stop the movement of the pump jack.

In order to alleviate this problem, one solution presented in the prior art is to provide a square hole in one side arm of the upper shackle 26, and to provide a square end onto the helical rod 28. During the upward climbing of the pump jack, the helical rod is manually placed axially so that the square end of the helical rod will fit into the square slot 32 provided on the shackle. This square arrangement will avoid unrolling of the helical rod during upward climbing. When downward rolling of the pump jack is desired, the helical rod must be manually moved so that the square portion of the helical rod will move out of the square slot provided in the shackle and thereby the unwinding of the helical rod can take place. Tradesman hammer to disengage this square slot.

With the prior art arrangement the helical rod itself often becomes distorted, the square slot often gets worn away, the square ends of the helical rod wears down, and in some occasions, the helical rod gets so tightly fixed into the square slot that the rod cannot be loosened from the slot and the pump jack gets hung up on the pole.

An additional problem with the prior art pump jack is that the helical rod 32 provides very little gripping and biting into the surface of the pole. As a result, during the downward movement, there has been a tendancy of this rod to slide rather than to roll down. Such sliding or slipping can be very dangerous during descent.

Further problems with the prior art design concerned releasing of the lower shackle 18 in order to provide downward travel of the pump jack As heretofore mentioned, during the downward travel, the lower shackle is moved out of grip of the pole. In order to do so, the lower shackle must be moved downward so that the front and rear bars 20, 22 are almost coplanar and are no longer angularly positioned with respect to the pole. In the prior art pump jack, this movement of the lower shackle 18 was achieved by having the worker bend around toward the front of the pump jack and actually kick onto the lower shackle 18 by means of his foot. Often, the worker might miss and would require numerous kicks. Sometimes, missing the lower shackle can take the worker off balance causing him to fall.

Furthermore, even after the lower shackle has been initially released, continued downward rolling of the pump jack by means of unwinding the helical rod may cause the lower shackle to again engage the pole and again start biting into the pole. As a result, again the lower shackle must be kicked or hit so as to release it. Since it has been found that the lower shackle keeps regripping the pole, it is general practice that the worker must crouch down, and hold the lower shackle 18 forward while he unwinds the handle 30. This positioning of the worker during such descent of the pump jack has been awkward, dangerous and extremely inconvenient. Nevertheless, this was required with prior art pump jacks.

Still another problem with prior art pump jacks was insertion of the foot into the pump arm 24. As is noted, there is provided a U-shaped member 34 coupled to the rear end of the pump arm 24 in which the foot can be inserted. With workers having different size and width shoes, it is often difficult for the worker to insert his foot properly into the pump arm 24. As a result, slippage occurs and frequently the worker was inconvenienced in not being able to properly get his foot into the pump arm 24.

Additional problems concerned the rear bars of both the upper and lower shackles. These bars were typically made square, as shown by the bar 22. In doing so, it was believed that additional gripping and biting into the back of the pole was achieved so as to provide better gripping of the shackles onto the pole. However, these square bars also provided additional friction during the stepping action which tended to scrape the poles and cause damage to the poles.

The aforementioned problems as well as numerous others, have raised questions concerning the safety and convenient use of such prior art pump jacks. Such questions with regard to the prior art pump jacks have been especially of importance as a results of changes occurring in the type of pole being utilized. Heretofore, the poles were formed of wood and typically comprised two 2 by 4s which were fastened together by nails to form a single pole. With the use of such poles, it was believed that gripping or biting into the poles was required on at least the front and rear sides in order to provide good coupling force and gripping of the pole. However, more recently, there has been provided aluminum pump jack poles having only one surface covered with a rubberized material Such poles are described in copending Ser. No. 143,506 filed by the inventor of the present application.

By utilizing such aluminum poles, it has become apparent that various ideas heretofore accepted with regard to the prior art pump jack can be modified. For example, it has been found that the gripping or biting into the pole need only take place on one side, and specifically on the front surface. The rear surface does not require biting action but only a pivotal or support on which a force is applied. As a result, with the shackles positioned angularly with respect to the pole, as long as the front bar bites into the rubberized surface of the pole, the rear bar need not bite into the pole but only abuts it. As a result, there need not be provided the square type of bars used at the back of the shackles.

Additional changes were realized during use of such aluminum pole which brought about a redesign and change in the pump jack. Such innovative changes are hereinafter described in connection with FIGS. 2 and 3.

Figure 2:
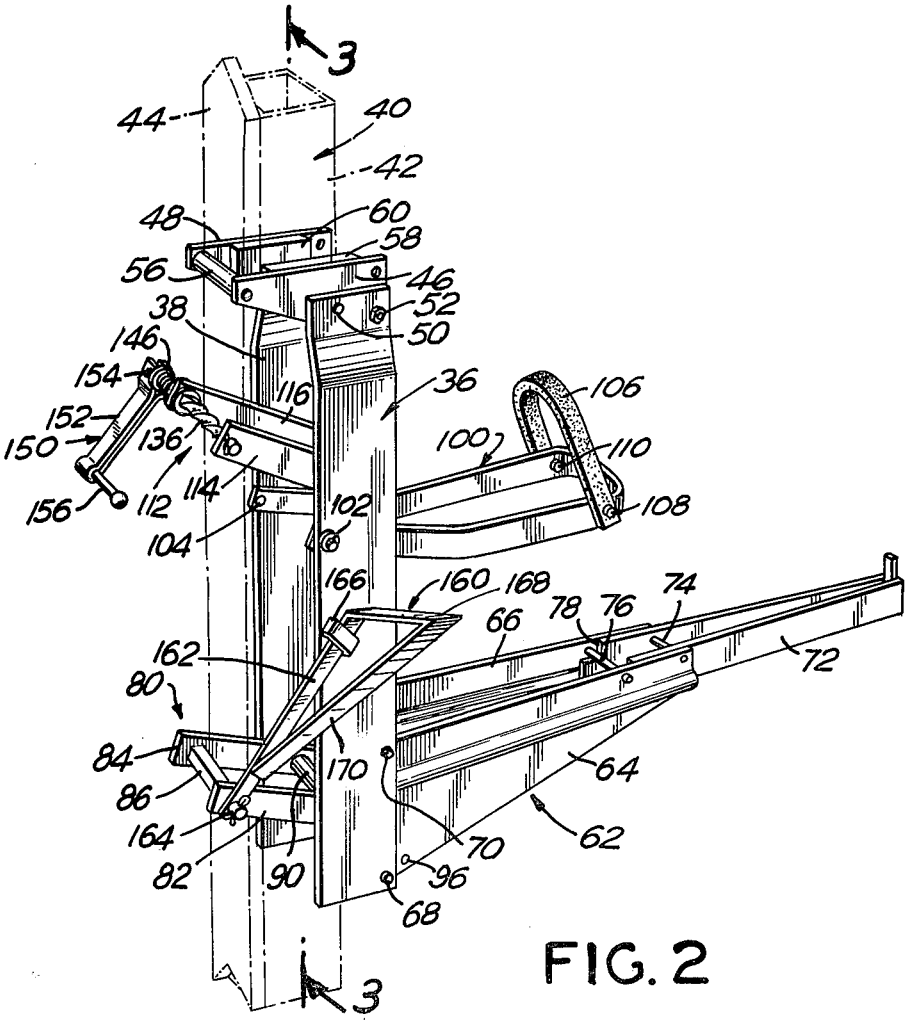
FIG. 2 is a perspective view of the pump jack in accordance with the present invention.
Figure 3:
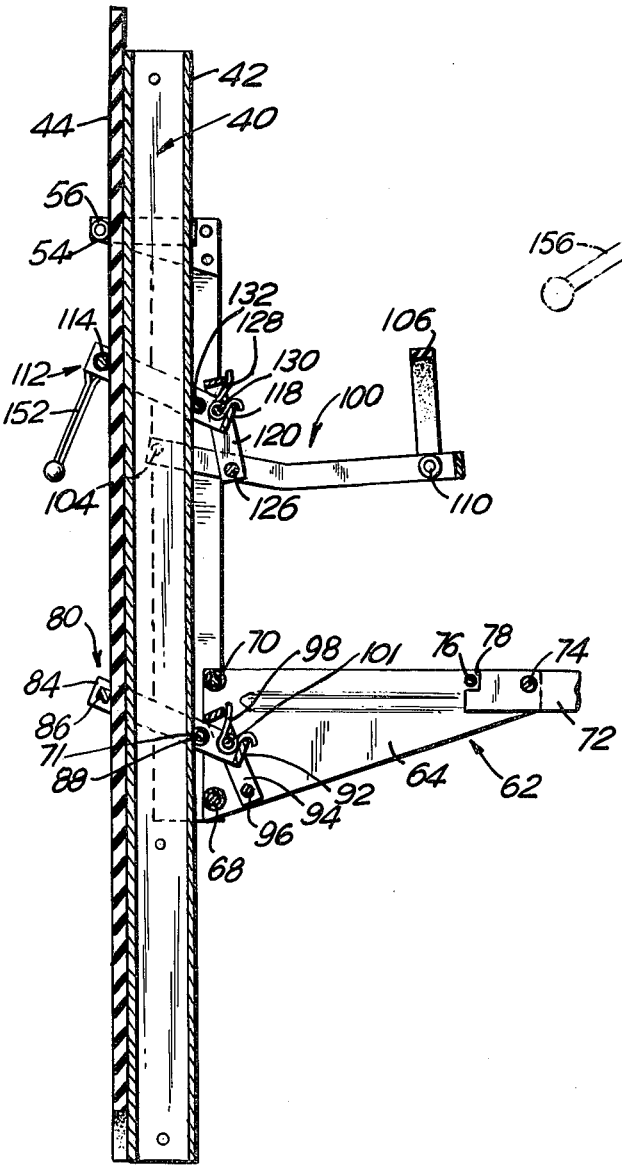
FIG. 3 is a vertical cross sectional view taken through line 3—3 of FIG. 2.

Referring now to FIGS. 2 and 3, it is noted that the pump jack is formed of a frame having side plates 36, 38 which straddle the pole 40. As shown, the pole 40 is of the type which includes an aluminum section 42 with a rubberized surface 44 on the front surface thereof.

At the upper end of the plates 36, 38 are positioned respective brackets 46, 48 which are riveted to the plates by means of the rivets 50 and are held in spaced apart relationship by means of a bolt 52 passing through the rear of the brackets and side plates. At the forward end of the brackets 46, 48 is supported a front rod 54 having a rotatable sleeve 56 thereabout. The front rod and sleeve form a front support for the pump jack during its operational use, as will hereinafter be described.

Additional spacers 58, 60 are placed on the internal sides of the brackets 46, 48 so as to provide a snug fit against the sides of the pole and avoid scraping of the pump jack up and down the pole. These spacers can be formed of plastic material so as to avoid additional friction while at the same time provide the proper spacing of the pump jack on the pole and avoid scraping of the pole by means of rivets, screws, etc.

At the lower end of the pump jack there is provided the platform support 62 formed on an opposing pair of brackets 64, 66 which are coupled to the side plates 36, 38 by means of the bolts 68, 70. Rearwardly extending from the platform support is an extension arm 72 which is pivotally connected to the bracket 62 by means of the pivot pin 74 which also fastens the extension 72 to the platform support 62. A front pin 76 fits into a seat 78 at the forward end of the extension arm 72 and forms a limit stop to the movement of the extension arm 72. As a result, during storage, the extension arm 72 can be pivoted upwardly out of the way. However, when in use, the extension arm 72 can be moved into the position shown in FIG. 2 whereby it provides a wider support on which the platform can be placed.

Pivotally supported from the platform is a lower shackle, shown generally at 80. The lower shackle is formed of a pair of side arms 82, 84, which support a front bar 86 shown as having a square cross sectional configuration and a rear bar 88 having a sleeve therearound 90. The rear ends of the side arm 82, 84, are interconnected by means of the bight portion 92. A U-shaped member 94 is pivotally connected to the platform by means of the pivot pin 96. A torsion spring 98 is wound around a rod 101 coupled to the U-shaped member 94 and biases the lower shackle 80 against the pole. As pressure is put onto the platform support 62, it biases the lower shackle into gripping relationship of the pole while with the weight slightly lifted from the platform, as for example when one foot is used to pump up the pump jack, the torsion spring removes the lower shackle from biting into the pole.

Rearwardly extending from the side plates 36, 38, is a substantially U-shaped pump arm 100 pivotally connected at its distal ends to the plate 36 through the rivet 102 with a corresponding rivet 104 coupling it to the side plate 38. At the rear of the pump arm 100 is connected a flexible U-shaped stirrup 106 typically formed of rubberized or leather material. The stirrup 106 is pivotally connected to the pump arm by means of the rivets 108, 110. An upper shackle 112 is pivotally coupled to the pump arm.

Figure 6:
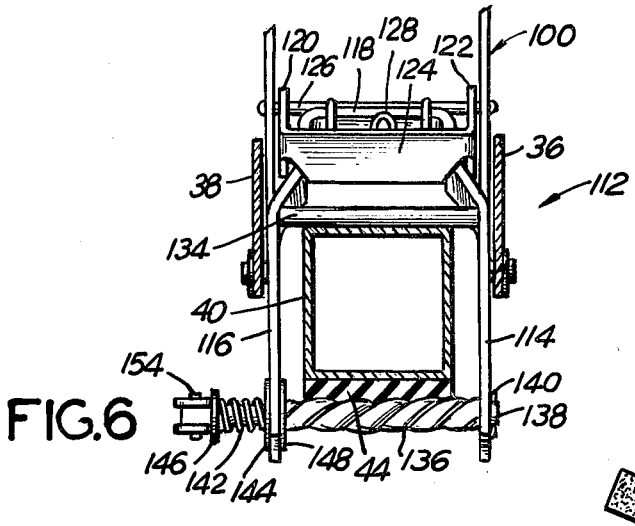
FIG. 6 is a cross sectional view taken along line 6—6 of FIG. 5.

As can best be seen in FIGS. 2, 3 and 6, the upper shackle comprises the side arms 114, 116 interconnected at their rear by the bight portion 118 so as to form a U-shaped member. Another U-shaped member includes the side arms 120, 122 interconnected by means of the bight portion 124. The side arms 120, 122 are pivotally connected to the pump arm 100 by means of the pivot pin 126. A torsion spring 128 is wound around a pin 130 whose ends are coupled to the side arms 120, 122.

By means of the torsion spring 128, the upper shackle is biased into gripping relationship as the pump arm moves downward. As the pump arm is moved upward, the upper shackle is released from gripping relationship.

At the rear of the upper shackle, there is provided a rod 132 covered by a sleeve 134. At the forward end of the shackle 112 there is provided a tight helical rod 136. One end of the rod extends through a circular opening provided in the arm 114 so as to provide a shaft 138 extending therefrom which can be secured by means of the cotter pin 140 extending therethrough. The other end of the rod 136 extends axially from the arm 116. A spring coil 142 is placed on that axial extension and is secured on either side by means of washers 144, 146. An additional washer 148 can be placed on the inner side of the arm 116.

A handle, shown generally at 150 is provided onto the distal end of the axial shaft forming the helical rod 136. The handle includes a coupling arm 152 whose distal end is pivotally coupled to the rod by means of the rivet 154.

At the forward end of the rod there is placed a crank arm 156 for grasping the handle and providing a convenient way of turning it. At the remote end of the rod, the rod material is formed with opposing flat surfaces which will abut the washer 146 so as to provide upper and lower positions, as will hereinafter be described. Effectively, the handle in conjunction with the spring forms an over the center spring arrangement having the two secure positions for use during upward and downward riding of the pump jack along the pole.

As can best be seen in FIG. 2, a release pedal, shown generally at 160 is utilized to release the lower shackle from gripping relationship with the pole. The release lever is shown as a triangular member having one leg 162 coupled at its lower end to the arm 82 of the lower shackle. A cotter pin 164 is used to retain the leg 162 connected to the extending shaft of the front bar 86 on the lower shackle 80. The leg 162 passes through a clamp 166 mounted on the side plate 36 forming a channel through which the leg 162 can slidably pass. The pedal 160 is at an angle with the frame 36, 38.

At the upper end of the leg 162 there is provided a leg 168 which forms the pedal on which the foot acts in order to lower the release. It should be noted that the leg 168 is angled toward the side plate 36 so that in case of sliding, the foot will slide toward the plate and will not accidentally slide off the jack. The third arm of the triangular shape release pedal 160 is the leg 170 which forms a brace for supporting the release pedal.

Operation of the pump jack will now be described. The pump jack is initially mounted onto the pump jack pole with the pump jack pole fitting between the two shackles as well as fitting within the upper clamp. The side plates of the pump jack frame straddle the pole. The rubberized surface of the aluminum pole, if one is being utilized, faces forward of the pump jack so that the square bar 86 of the lower shackle and the helical rod 136 of the upper shackle will bite into the rubberized surface. Additionally, the upper roller 56 of the clamp will provide a pivot support onto the rubberized surface.

Figure 5:
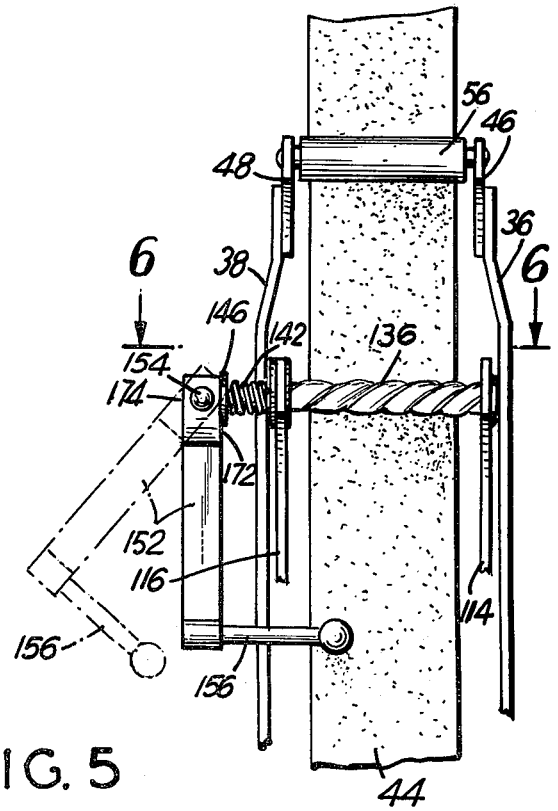
FIG. 5 is a view similar to that shown in FIG. 4 and showing the handle in its safety locked position.

For upward movement, the handle connected to the upper shackle is turned downwardly as shown in FIGS. 2 and 5, so that the crank arm 156 points inwardly. With the crank arm pointed inwardly, as shown in FIG. 6, it will lock against the front surface 44 of the pole and thereby prevent unwinding of the helical rod 136. This feature of the over the center spring handle provides a safety feature which avoids the possibility of having the pump jack roll down the pole. Once the handle is turned downwardly so that the crank arm 156 of the handle is faced inwardly, it naturally locks against the front surface of the pole and prevents accidental unrolling of the helical rod.

Figure 4:
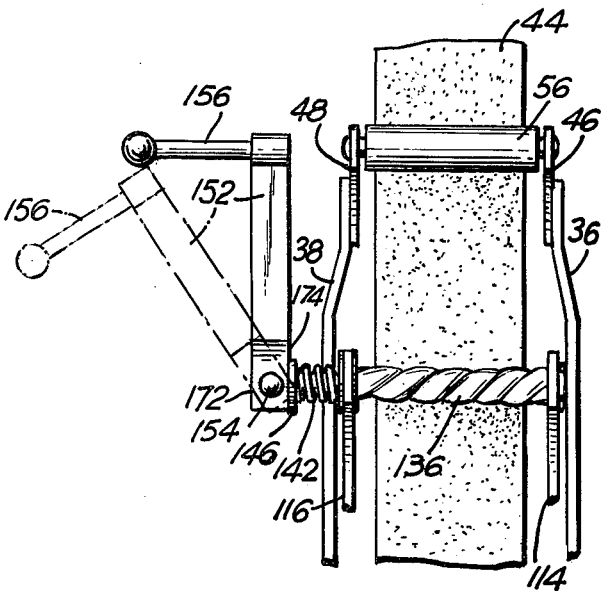
FIG. 4 is a partial front view showing the spring loaded handle in its cranking position.

On the other hand, during downward descent of the pump jack along the pole, the handle is moved into a position as shown in FIG. 4 with the handle facing upward so that the crank arm 156 faces outwardly. In this orientation, the crank arm 156 is available for downward turning so that the helical rod 136 will roll down the front surface 44 of the pole and thereby bring down the pump jack.

The two positions of the handle are held in place by means of forming a flat surface 172 on one side of the handle 152 at a similar flat surface 174 on the opposing side of the handle 152. In this way, these two flat surfaces abut against the washer 146 and are held securely in place by means of the spring 142. It should also be appreciated that for storage and transport, the handle can be turned inwardly, in the position shown in FIG. 5, whereby the handle will not be in the way for possibly causing accidents.

Figure 7:
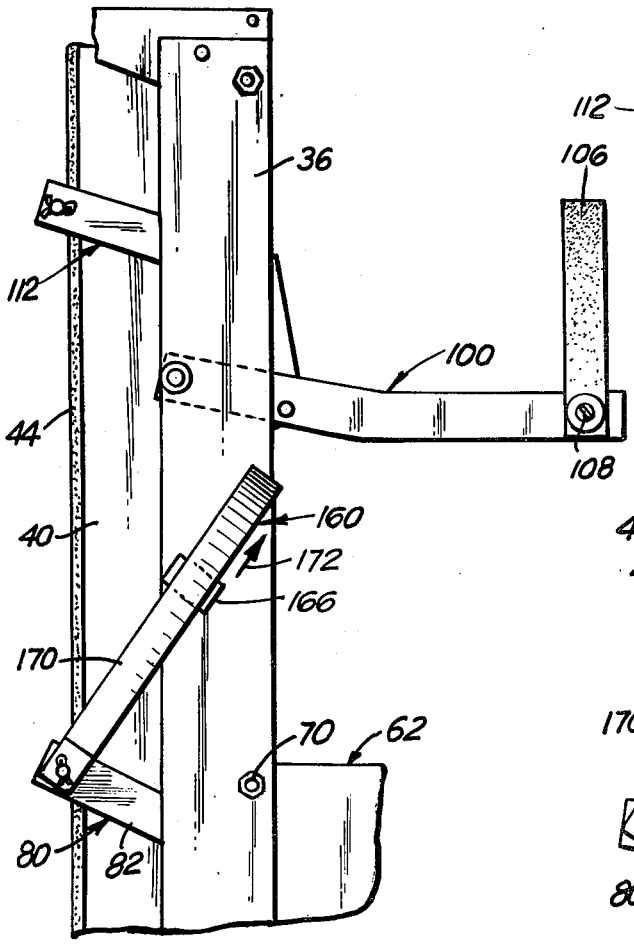
FIG. 7 is a partial side view showing the position of the release lever and pump arm during upward climbing of the pump jack on the pump jack pole.

Referring now to FIG. 7, it will be noted that for upward climbing of the pump jack, the release pedal 160 is in its upward position, as shown by the arrow 172. In this position, the lower shackle 80 is angular positioned with its forward bar 86 upward with respect to the lower bar so that a suitable coupling force can be placed onto the pole to grip it when properly biased.

Figure 8:
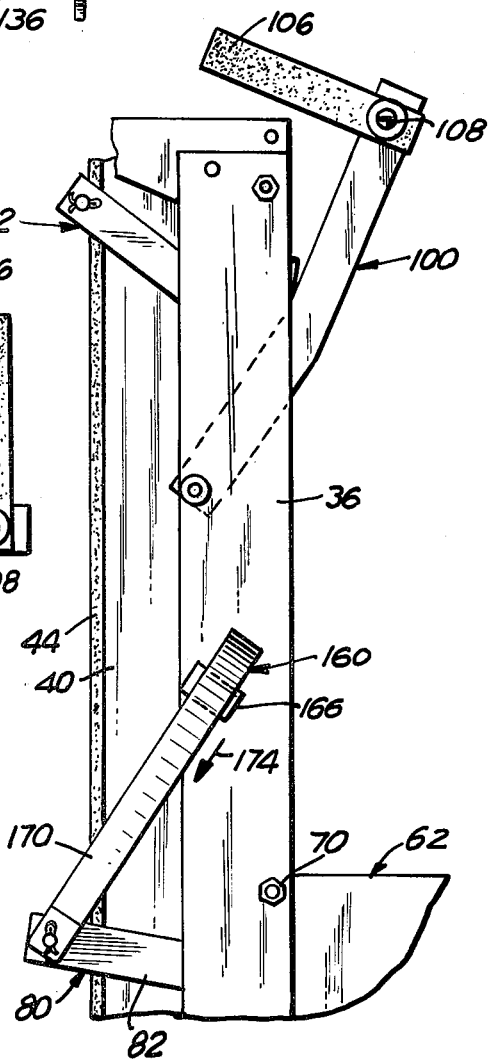
FIG. 8 is a view similar to that of FIG. 7 and showing the position of the release lever and pump arm during descending of the pump jack along the pump jack pole.

As seen in FIG. 8, in order to lower the pump jack down the pole, the release pedal 160 is moved forward so that the lower shackle 80 is moved to its down position whereby it is released from gripping the pole and thereby be out of the way so that the upper shackle can be rolled down the pole by means of the helical rod.

With the pump jack mounted onto the pole, and with the handle turned inwardly so that it provides a safety lock and avoids accidental sliding down of the pole, the worker can place the platform on the platform support. By placing the foot in the stirrup 106 provided on the pedal arm 100, he can pump the pump jack up the pole. The use of the stirrip facilitates entry of the shoe into the pump arm and avoids difficulty in pumping. It also accomodates for different size shoes and different shapes of shoes.

With a downward pumping stroke on the pump arm, the upper shackle grips the pole and the pump jack is stepped upwardly. The lower shackle is slightly biased away from gripping action during this time. During the upward stroke of the pump arm, the lower shackle grips the pole with the uppwer shackle slightly released from the pole so that the upper shackle is stepped upwardly. This alternate stepping brings the pump jack up to a desired height.

When it is desired to lower the pump jack, the handle is moved from its safety position as shown in FIG. 5 to its operational position as shown in FIG. 4. Also, the release pedal 160 is pushed downward. In order to move it downwardly, the foot is placed on the upper portion 168 of the foot pedal and force is exerted by means of the foot. It should be noted, that by positioning the release pedal 160 above the platform support 62, the worker can operate the release pedal while standing on the platform and thereby avoid crouching downward. Furthermore, he can remain in an upright position and continuously keep his foot on the release pedal so that the lower shackle will be in the position as shown in FIG. 8. At the same time, he can be in an upright position to easily wind downward the crank arm 156 thereby lowering the pump jack down the pole.

It should be appreciated that once it is realized that it is only the outer bars that grip the pole, the inner bars of the upper and lower shackle can be made of rods with sleeves around them to avoid cutting or biting into the pole or scraping it. As a result, the rear bars 90 on the lower shackle and 130 on the upper shackle are formed with sleeves therearound to facilitate upward and downward moving of the pump jack along the pole without cutting into the pole.

An additional feature of the present invention concerns the presence of the spring 142 which biases the helical rod 136. By means of the spring, a force is applied onto the helical rod 136 which aids in preventing accidental unwinding of the helical rod 136 during all times. Furthermore, the helical rod itself is made into a tight spiral so as to better grip the surface of the pole and avoid any sliding or slipping.

By means of the present invention, it has been found that the pump jack is easier to operate, more suitable for aluminum poles, and provides much improved safety features. This improved pump jack provides for easier use and more acceptability.

There has been disclosed heretofore the best embodiments of the invention presently contemplated. However, it is to be understood that various changes and modifications may be made thereto without departing from the spirit of the invention.

I claim:

1. A pump jack arranged for travelling up and down a pole, comprising:

a frame member;

a lower shackle member supported on said frame member, having front and rear clamping bars for applying a coupling force for gripping the pole;

a pump arm pivotally coupled to said frame member;

an upper shackle member pivotally coupled to said pump arm, having a front helical rod and a rear clamping bar for applying a coupling force for gripping the pole;

biasing means responsive to the pumping action of the pump arm for alternately positioning one of said shackle members in gripping relationship with the pole;

said pump arm pivotally stepping upward said frame member during a pump stroke while said upper shackle member grips the pole and pivotally stepping upward said upper shackle member during a reverse stroke while said lower shackle member grips the pole;

release means for disengaging said lower shackle member from the pole, and an over the center spring loaded handle means coupled to said helical rod for rolling the pump jack down the pole and for preventing downward rolling during the upward stepping action, wherein said handle means has a first position for cranking of said helical rod and a second position for locking of said helical rod.

2. A pump jack as in claim 1, wherein said handle means comprises an axial shaft laterally extending from said helical rod beyond said lower shackle member, a handle having a coupling arm and a crank arm arranged in an L-shaped configuration, the distal end of said coupling arm pivotally connected to the end of said axial shaft, and a spring mounted on said shaft extending between said handle and said lower shackle member, whereby said L-shaped handle is spring held in said first position wherein said crank arm extends outwardly of said frame member, and said second position wherein said crank arm extends inwardly towards said frame member for locking against the pole and thereby preventing unwinding of said helical rod.

3. A pump jack as in claim 2, and further comprising a washer coupled at the remote end of the spring, and wherein said coupling arm comprises opposing flat surfaces for abutting said washer and retaining said handle means in said respective first and second positions.

4. A pump jack as in claim 1, wherein said helical rod comprises a tight spiral.

5. A pump jack as in claim 1, wherein said helical rod has circular shafts axially extending laterally therefrom, and wherein said lower shackle member comprises a pair of side arms, circular holes formed at the distal ends of said side arms for receiving the axially extending shafts therebetween.

6. A pump jack as in claim 1, and further comprising a flexible stirrup pivotally mounted at the distal end of said pump arm for facilitating foot pumping of said pump arm.

7. A pump jack as in claim 1, wherein said rear clamping bars of both shackle members comprise a circular rod with a sleeve formed therearound to facilitate the up and down travel of the pump jack along the pole.

8. A pump jack as in claim 1, wherein said frame member comprises a pair of side plates coupled together in spaced apart relationship for straddling the pole, and bumper plates positioned inwardly of each side plate for avoiding scraping of the pole.

9. A pump jack as in claim 1, and further comprising pressure means applied to said helical rod for preventing accidental unwinding of said helical rod.

10. A pump jack arranged for travelling up and down a pole, comprising:

a frame member;

a lower shackle member supported on said frame member, having front and rear clamping bars for applying a coupling force for gripping the pole;

a pump arm pivotally coupled to said frame member;

an upper shackle member pivotally coupled to said pump arm, having a front helical rod and rear clamping bar for applying a coupling force for gripping the pole;

biasing means responsive to the pumping action of the pump arm for alternately positioning one of said shackle members in gripping relationship with the pole;

said pump arm pivotally stepping upward said frame member during a pump stroke while said upper shackle member grips the pole and pivotally stepping upward said upper shackle member during a reverse stroke while said lower shackle member grips the pole;

release means for disengaging said lower shackle member from the pole, and an over the center, spring loaded handle means coupled to said helical rod for rolling the pump jack down the pole and for preventing downward rolling during the upwards stepping action, wherein said release means comprises a release pedal coupled to said lower shackle member and angularly extending to said frame member.

11. A pump jack as in claim 10, wherein said release pedal comprises an elongated rod having its lower end coupled to the front of said lower shackle member, its body portion slidably coupled to said frame member, and a foot pedal coupled to the upper end of said rod.

12. A pump jack as in claim 11 and further comprising a platform support extending from said frame member at a location slightly lower than said foot pedal, and wherein said handle means is located above said platform support, whereby a user standing on a platform can manipulate said foot pedal with his foot and manipulate said handle means with his hand while standing in an upright position.

13. A pump jack as in claim 11, wherein said foot pedal is angularly sloped towards said frame member.

* * * * *